US006525998B1

(12) United States Patent
Taylor

(10) Patent No.: US 6,525,998 B1
(45) Date of Patent: Feb. 25, 2003

(54) COMMEMORATIVE TIMEPIECE

(76) Inventor: Karen A. Taylor, 1588 Spangler, Florissant, MO (US) 63031

( * ) Notice: Subject to any disclaimer, the term of this patent is extended or adjusted under 35 U.S.C. 154(b) by 0 days.

(21) Appl. No.: 09/955,605

(22) Filed: Sep. 19, 2001

(51) Int. Cl.[7] ..... G04B 19/00; G04B 19/04
(52) U.S. Cl. ..... 368/223; 368/228; 368/80
(58) Field of Search ..... 368/223, 228, 368/80, 238, 296, 10

(56) References Cited

U.S. PATENT DOCUMENTS

| | | | | | |
|---|---|---|---|---|---|
| 533,473 | A | | 2/1895 | Kintner | 116/308 |
| 1,317,375 | A | | 9/1919 | Leigh | 116/308 |
| 1,515,154 | A | | 11/1924 | Fergusson | 116/308 |
| 1,768,100 | A | * | 6/1930 | Baumgarten | 368/228 |
| 1,819,063 | A | | 8/1931 | Barron | 116/316 |
| 1,940,453 | A | | 12/1933 | Hitchcock | 116/308 |
| 2,177,978 | A | | 10/1939 | Darvie | 116/315 |
| 2,676,455 | A | * | 4/1954 | McNeight | 368/137 |
| 2,863,417 | A | | 12/1958 | Newton | 116/314 |
| 3,316,709 | A | * | 5/1967 | Edwards | 368/27 |
| 3,853,090 | A | | 12/1974 | Watson et al. | 116/308 |
| 4,012,900 | A | * | 3/1977 | Enright | 368/238 |
| 4,389,122 | A | * | 6/1983 | Dubois et al. | 368/110 |
| 4,426,159 | A | * | 1/1984 | Kosaka et al. | 368/80 |
| 5,058,084 | A | * | 10/1991 | Riesen | 368/10 |
| 5,271,353 | A | | 12/1993 | Besthorne | 116/308 |
| 5,457,902 | A | | 10/1995 | Rubin | 40/107 |
| 5,862,102 | A | * | 1/1999 | Trainello | 368/223 |
| 5,881,482 | A | | 3/1999 | Goldman | 40/495 |

* cited by examiner

*Primary Examiner*—David Martin
*Assistant Examiner*—Michael L. Lindinger
(74) *Attorney, Agent, or Firm*—Grace J. Fishel

(57) ABSTRACT

A functional commemorative timepiece to memorialize an event such as a birth, marriage or the like has a first and second set of pointers. The first set of pointers are under a crystal and move across a dial for indicating the current time of day. The second set of pointers are stationary and are attached to the crystal for indicating the hour and minute at which the event to be memorialized occurred. There is a bezel around the crystal with a legend indicating the event being memorialized and a festoon may be provided with markings correlated with the legend.

10 Claims, 3 Drawing Sheets

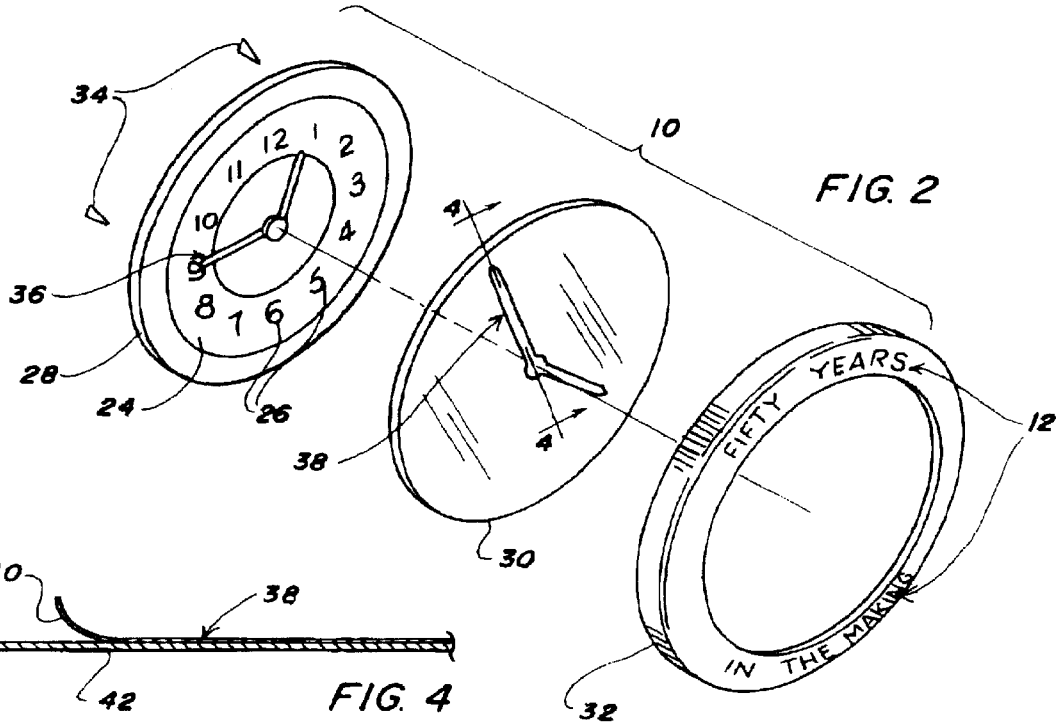
FIG. 2
FIG. 4
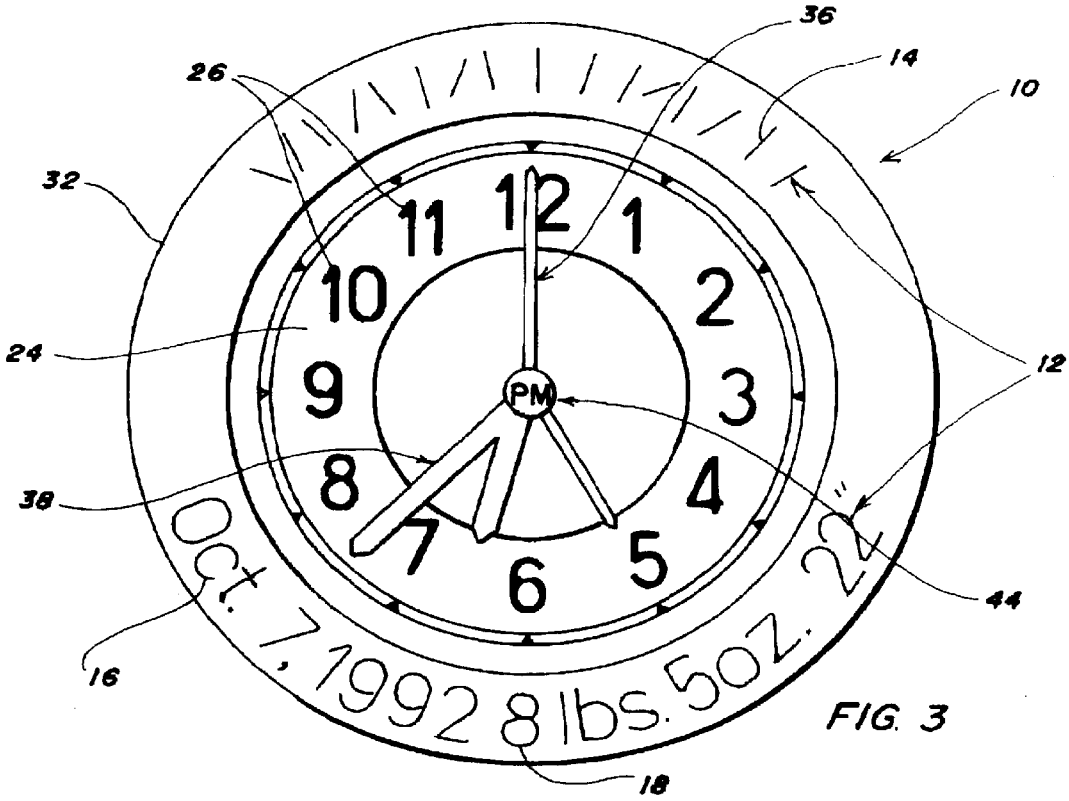
FIG. 3

COMMEMORATIVE TIMEPIECE

BACKGROUND OF THE INVENTION

1. Field of the Invention

The present invention relates to a timepiece for commemorating an event such as a birth.

2. Brief Description of the Prior Art

People like tangible reminders of important life events such as birth, marriage, etc. There are stores that specialize in "things remembered" with plaques and other knickknacks, which are given as gift items. On display, these items blend into the background after a while and are not noticed at all. There is a need for a tangible reminder of an event such as a birthday that is functional such that it continues to draw attention. Such a device could be used to commemorate a milestone event such as turning 30, 40, 50 or like.

In the prior art there are toy clocks with movable hands that can be attached to a medicine bottle for use in reminding a person when it is time to take the next dose (e.g., U.S. Pat. No. 5,271,353 to Besthorne). There are also devices that attach with a suction cup to the face of a watch (e.g., U.S. Pat. No. 1,940,453 to Hitchcock) for reminding a person when it is time to perform the next act in a recurrent series of acts, such as taking medicine. Neither the Besthorne or Hitchcock devices provides a functional timepiece for memorializing a life event such as a birth.

BRIEF SUMMARY OF THE INVENTION

In view of the above, it is an object of the present invention to provide a functional timepiece for commemorating an important life event such as a birth, marriage, etc. It is another object to provide a tangible reminder of an event that is functional such that it continues to draw attention. Other objects and features of the invention will be in part apparent and in part pointed out hereinafter.

In accordance with the invention, a commemorative timepiece to memorialize an event such as a birth, marriage or the like has a first and second set of pointers. The first set of pointers are under a crystal and move across a dial for indicating the current time of day. The second set of pointers are attached to the crystal. The second set of pointers are stationary for indicating the hour and minute at which the event to be memorialized occurred. There is a bezel around the crystal with a legend indicating the event being memorialized. A festoon may be provided with markings correlated with the legend.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which:

FIG. 2 is an exploded perspective view of the timepiece with a frame, base and festoon removed;

FIG. 3 is a plan view of a second timepiece in accordance with the present invention for memorializing the name, date, weight and time of birth of a baby;

FIG. 4 is a view taken along line 4—4 in FIG. 2 showing a means for attaching a stationary second set of pointers to the face of the crystal; and, FIG. 5 is an exploded side view of the timepiece shown in FIG. 1.

DETAILED DESCRIPTION OF THE INVENTION

Figure 1:
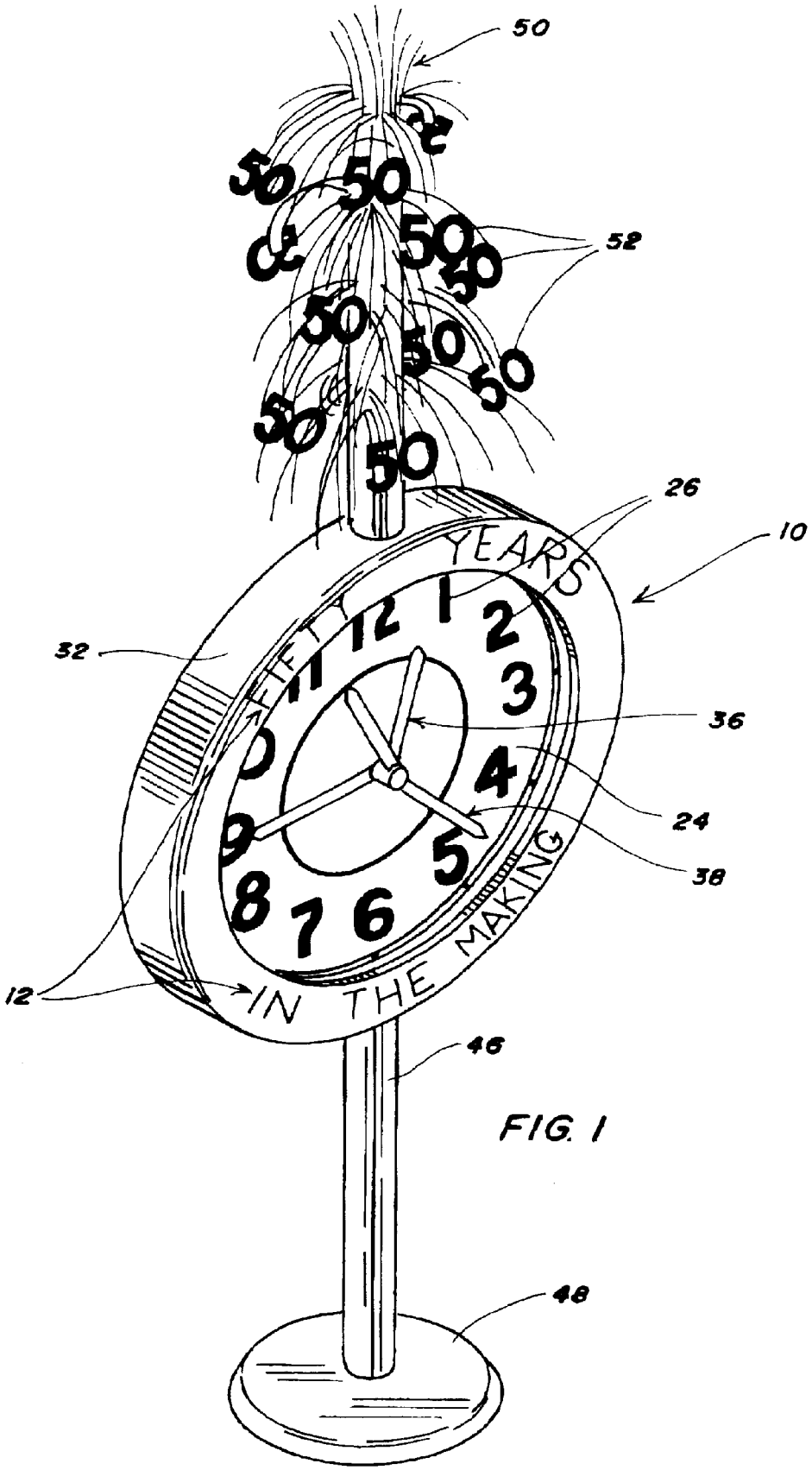
FIG. 1 is a perspective view of a timepiece in accordance with the present invention for memorializing an event such as turning fifty.

Referring to the drawings more particularly by reference number, reference numeral 10 refers to a commemorative timepiece in accordance with the present invention. Timepiece 10 may be used to commemorate an important life event such as a birth, marriage, beginning of a business, etc. It may also be used to commemorate a meeting such as "The first time I saw you" and so forth. In the drawings two representative events are illustrated. Referring first to FIG. 1, a legend 12 is provided for memorializing a 50th birthday. In FIG. 3, legend 12 provides a name 14, a birth date 16 and a weight 18 of a baby, which particulars are being memorialized.

Timepiece 10 is an analog device and may be a clock or a watch. When it is a watch, it may be carried in a pocket, worn on a wrist, etc. Whereas, when it is a clock, it cannot be worn and is not intended to be carried about. In the drawings, timepiece 10 is illustrated in clock form, but it will be understood that it can be a watch with a watchband, pocket watch with a chain or cord, or the like.

Timepiece 10 includes a case 20 within which is housed a timekeeping mechanism 22. Today's timekeeping mechanisms fall into two categories: Mechanical or quartz. Mechanical movements mark the passage of time by a series of gear mechanisms. Quartz movements are powered by a battery. It will be apparent that timepiece 10 is not limited to a particular timekeeping mechanism 22.

A dial 24 is attached to case 20. Dial 24 has indications 26 to show hours and, in some embodiments, additional functions. For example a two-function timepiece has indications 26 for the hours and minutes, whereas a six-function timepiece indicates hours, minutes, seconds, the day of the week, the day of the month and the month. Years may also be indicated in some timepieces, phases of the moon, etc. Indications 26 may take the form of numerals, divisions or symbols of various types. Indications 26 may be applied to dial 24 as separate parts, but more commonly, particularly in less expensive timepieces, may be printed on. In the embodiment illustrated in FIGS. 1, 2 and 5, a plate 28 is provided with a front side and rear side. Case 20 may be attached to the rear side of plate 28 and dial 24 to the front side thereof.

Figure 5:
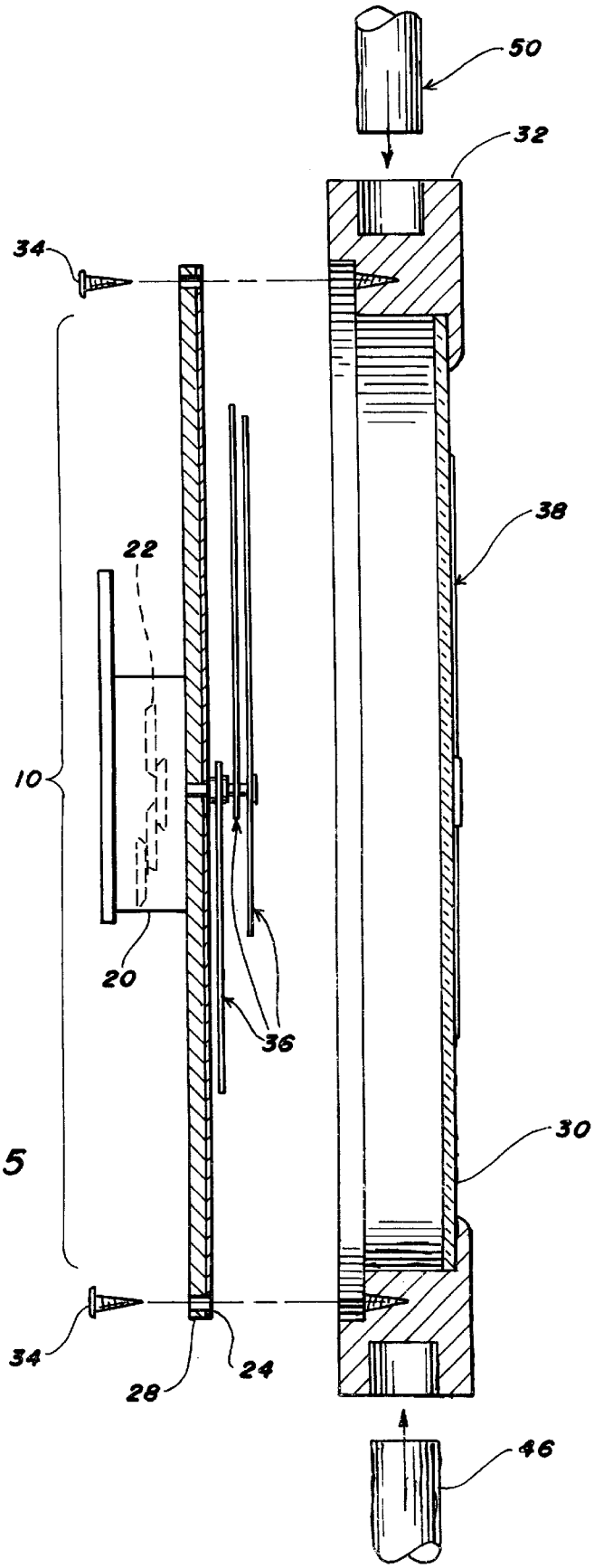

A crystal 30 is provided for protecting dial 24. Crystal 30 is a thin sheet of glass or transparent synthetic material. A bezel 32 is provided for attaching crystal 30 to case 20 over dial 24, indirectly through plate 28 as shown in the drawings or directly as in the case of a wristwatch. When timepiece 10 is a watch, bezel 32 is slip fitted, threaded or otherwise attached to case 20. As best seem in FIG. 5, bezel 32 is attached to plate 28 with attachment means 34 such as screws. Clips, nails, glue or the like may also be used as attachment means 34. In the embodiment shown in the drawings, as best seen in FIG. 5, bezel 32 encircles plate 28 and screws 34 are threaded into the backside of the bezel 32 which may be formed of wood, a composite fiberboard material or the like. Legend 12 of the event being memorialized, as discussed above, is provided on the front side of bezel 32.

Crystal 30 has an inside and an outside. A first set of pointers 36 are provided under crystal 30. First set of pointers 36 are driven by timekeeping mechanism 22 and move over dial 24 for indicating the current time of day. There are many different kinds of hands which may be used for first set of pointers 36. Included hands are alpha (a hand that is slightly tapered), baton (a narrow hand sometimes referred to as a "stick hand" ), dauphine (a wide, tapered hand with a facet at the center running the length of the hand), skeleton (hands with cutouts), luminous (hands covered with a luminous material) and so forth.

A second set of pointers 38 are provided on crystal 30. Second set of pointers 38 are stationary and may be selectively attached to the inside or outside of crystal 30 with an adhesive 40 having a peel-off backing 42 as shown in FIG. 4. Second set of pointers 38 may also be printed, painted, etched or the like on crystal 30 where they are set to indicate the hour and minute at which the event to be memorialized occurred. Second set of pointers 36 simulate the operating hands of first set of pointers 36. When the event to be memorialized occurs, first set of pointers 36 are eclipsed by second set of pointers 38. Second set of pointers 38 are anchored to the center of crystal 30 and may include a second legend 44 associated with the event being memorialized such as "am" or "pm."

When timepiece 10 is a clock, it may be supported on a frame 46 which is mounted on a base 48. In this form, timepiece 10 may be displayed on a desk, credenza or some other piece of furniture. A detachable festoon 50 may be attached to the frame or to bezel 32. Festoon 50 may have markings 52 to indicate the event being memorialized. As shown in FIG. 1, markings 52 are the number 50 and correlate with legend 12 which states "FIFTY YEARS IN THE MAKING."

In use, timepiece 10 is customized by the manufacturer, distributor or retailer to the event being memorialized. Alternatively, second set of pointers 38, first and second legends 12 and 44 and markings 52 (if any) may be applied by the purchaser from a set of numbers and letters provided with timepiece 10. The numbers and letters in the set may have adhesive 40 with peel-off backing 42 which facilitates the customization. Instead, stencils might be provided such that the purchaser can paint, print or etch second set of pointers 38 on crystal 30 and legend 12 on bezel 32, as desired.

Timepiece 10 is intended for use as a display item. Depending on the materials selected for timekeeping mechanism 22, case 20, etc., timepiece 10 may be provided as an inexpensive gift item, competitive with plaques and other knickknacks. On the other hand, timepiece 10 may be provided as an expensive grandfather-style clock with second set of pointers 38 etched into crystal 30 which may be made of sapphire crystal glass. In any form, second set of pointers 38 do not obstruct viewing of the time. Since timepiece 10 is functional, it will continue to draw attention, unlike most knickknacks, and likely be a source of continuing joy to the recipient.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A commemorative timepiece to memorialize an event, said timepiece comprising a case within which is housed a timekeeping mechanism, a dial attached to the case, said dial having indications to show the hours, a crystal for protecting the dial, a bezel for attaching the crystal to the case and over the dial, a legend on the bezel indicating the event being memorialized, a first set of pointers under the crystal driven by the timekeeping mechanism, said first set of pointers moving over the dial for indicating the current time of day and a second set of stationary pointers on the crystal for indicating the hour and minute at which the event to be memorialized occurred.

2. The timepiece of claim 1 being a clock supported on a frame mounted on a base.

3. A commemorative timepiece to memorialize an event, said timepiece comprising a case within which is housed a timekeeping mechanism, a plate with a front and rear side, said case attached to the rear side of the plate and a dial attached to the front side of the plate, said dial having indications to show the hours, a crystal for protecting the dial, a bezel for attaching the crystal to the plate over the dial, a legend on the bezel indicating the event being memorialized, a first set of pointers under the crystal driven by the timekeeping mechanism, said first set of pointers moving over the dial for indicating the current time of day and a second set of stationary pointers on the crystal for indicating the hour and minute at which the event to be memorialized occurred.

4. The timepiece of claim 3 being a clock wherein the bezel is attached to the plate with attachment means.

5. The timepiece of claim 4 wherein the attachment means are screws.

6. The timepiece of claim 3 being a clock supported on a frame mounted on a base.

7. The timepiece of claim 6 wherein a detachable festoon is attached to the frame or bezel and positioned above the dial.

8. The timepiece of claim 3 wherein the second set of pointers are attached to the crystal with adhesive, said adhesive protected with a peel-off backing prior to application to the crystal.

9. The timepiece of claim 3 wherein the second set of pointers are painted, printed or etched on the crystal.

10. A commemorative clock to memorialize an event, said clock comprising a case within which is housed a timekeeping mechanism, a plate with a front and rear side, said case attached to the rear side of the plate and a dial attached to the front side of the plate, said dial having indications to show the hours, a crystal for protecting the dial, a bezel for attaching the crystal to the plate over the dial, a legend on the bezel indicating the event being memorialized, a first set of pointers under the crystal driven by the timekeeping mechanism, said first set of pointers moving over the dial for indicating the current time of day and a second set of stationary pointers on the crystal for indicating the hour and minute at which the event to be memorialized occurred, said second set of pointers attached to the crystal with adhesive, said adhesive protected with a peel-off backing prior to application to the crystal, said clock supported on a frame mounted on a base, said frame or bezel having means for attaching a detachable festoon with markings to show the event being memorialized.

* * * * *